US006446651B1

(12) United States Patent
Abbel

(10) Patent No.: US 6,446,651 B1
(45) Date of Patent: Sep. 10, 2002

(54) MULTI-CHAMBER VACUUM SYSTEM AND A METHOD OF OPERATING THE SAME

(75) Inventor: Karl Abbel, Braunfels (DE)

(73) Assignee: Pfeiffer Vacuum GmbH, Asslar (DE)

( * ) Notice: Subject to any disclaimer, the term of this patent is extended or adjusted under 35 U.S.C. 154(b) by 0 days.

(21) Appl. No.: 09/604,452

(22) Filed: Jun. 27, 2000

(30) Foreign Application Priority Data

Jun. 28, 1999 (DE) ..... 199 29 519

(51) Int. Cl.[7] ..... E03B 1/00

(52) U.S. Cl. ..... 137/1; 137/565.23; 137/565.29; 118/715

(58) Field of Search ..... 137/565.23, 565.29, 137/565.3, 565.33, 1; 118/715, 716

(56) References Cited

U.S. PATENT DOCUMENTS

| | | | | |
|---|---|---|---|---|
| 3,537,474 A | * | 11/1970 | Rohrer | 137/565.23 |
| 3,986,521 A | * | 10/1976 | Wittmann-Liebold et al. | 137/565.23 X |
| 5,228,838 A | | 7/1993 | Gebele et al. | |
| 5,244,352 A | | 9/1993 | Mugele | |
| 5,433,238 A | * | 7/1995 | Cannizzaro et al. | 137/565.29 X |
| 5,469,885 A | * | 11/1995 | Nishimura | 137/565.23 |
| 5,733,104 A | | 3/1998 | Conrad et al. | |
| 5,863,842 A | * | 1/1999 | Ohmi | 118/715 X |
| 6,004,109 A | | 12/1999 | Gebele et al. | |
| 6,074,486 A | * | 5/2000 | Yang et al. | 118/715 X |
| 6,080,679 A | * | 6/2000 | Suzuki | 118/715 X |
| 6,113,698 A | * | 9/2000 | Raaijmakers et al. | 118/715 |
| 6,161,576 A | * | 12/2000 | Maher et al. | 137/565.23 |

FOREIGN PATENT DOCUMENTS

| | | |
|---|---|---|
| DE | 19645104 | 5/1998 |
| EP | 0510656 | 10/1992 |
| EP | 0690235 | 1/1996 |

OTHER PUBLICATIONS

Japanese Patent Abstract No. 63–232833, Sep. 1988.
Japanese Patent Abstract No. 3–161042, Jul. 1991.

* cited by examiner

*Primary Examiner*—John Rivell
(74) *Attorney, Agent, or Firm*—Sidley Austin Brown & Wood, LLP

(57) ABSTRACT

A vacuum system including first and second vacuum chambers, a high-vacuum pump having its inlet connected with the first vacuum chamber, a dischargeable into atmosphere, vacuum pump for evacuating both first and second vacuum chambers; a first valve for connecting an inlet of the dischargeable in atmosphere, vacuum pump with an outlet of the high-vacuum pump, and a second valve for connecting the inlet of the dischargeable in atmosphere, vacuum pump with the second vacuum chamber.

2 Claims, 1 Drawing Sheet

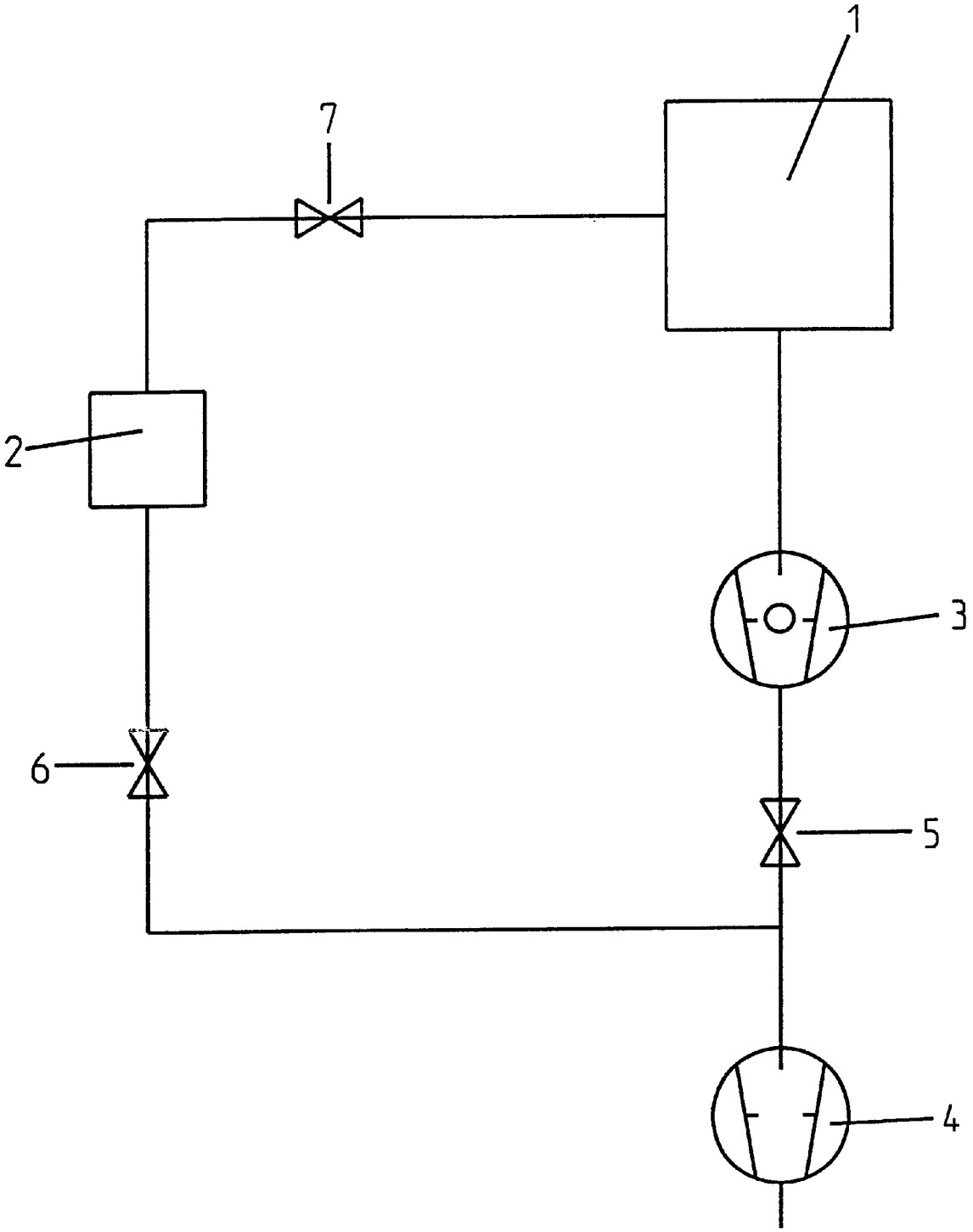
1
7
2
3
6
5
4

MULTI-CHAMBER VACUUM SYSTEM AND A METHOD OF OPERATING THE SAME

BACKGROUND OF THE INVENTION

1. Field of the Invention

The present invention relates to a vacuum system including first and second vacuum chambers, a high-vacuum pump connected with the first vacuum chamber, and vacuum pump means for evacuating both vacuum chambers. The present invention also relates to a method of operating such a vacuum system.

2. Description of the Prior Art

A major portion of all chemical and physical processes, which take place in industry and in research, can be conducted only in vacuum or in a specific atmospheric environment. Because of a large number of different atmospheric conditions such as, e.g., as pressure and gas compositions, the characteristics of vacuum pumps, which are used for creating specific atmospheric conditions, should meet different specific requirements. Also on many occasions, a vacuum system of a specific process plant should meet different requirements. For example, vacuum requirements can vary for different processes. Thus, a process, which is conducted in one of the chambers, may require an oil-free high vacuum, whereas the process conducted in the other chamber does not require such stringent conditions and can be conducted under a low vacuum. In such cases, for example, for a high-vacuum operation, a turbo-molecular pump, which is driven by a dischargeable into atmosphere, vacuum pump, is used, whereas for creating the low vacuum, another, dischargeable into the atmosphere vacuum pump is used.

Two separate, dischargeable into atmosphere, vacuum pumps were needed because the vacuum, which was produced by the two pumps, was used for different purposes and, therefore, no connection therebetween could be tolerated. From the above, it follows that an effective operation of the high-vacuum turbomolecular pump could take place only when the associated therewith fore-vacuum pump is permanently connected with it and produces the necessary vacuum. The provision of two, dischargeable into the atmosphere pumps, increases manufacturing and operational costs and space requirements.

Accordingly, an object of the present invention is to provide a multi-chamber vacuum system characterized by reduced manufacturing and operational costs and by reduced spaced requirements. Another object of the present invention is to provide a method of operating such a system.

SUMMARY OF THE INVENTION

These and other objects of the present invention, which will become apparent hereinafter, are achieved by providing a multi-chamber vacuum system in which a vacuum pump dischargeable into atmosphere, is connected by appropriate valve means with several chambers for alternatively or simultaneously, in the initial period, evacuating the same. Specifically, a multi-chamber vacuum system according to the present invention has two vacuum chambers, a high-vacuum pump having its inlet connected with the first vacuum chamber, and a vacuum pump for evacuating both first and second vacuum chambers and dischargeable into atmosphere. A first valve connects an inlet of the dischargeable into atmosphere, vacuum pump with an outlet of the high-vacuum pump, and a second valve connects the inlet of the dischargeable into atmosphere, vacuum pump with the second vacuum chamber.

Since some time ago, turbomolecular pumps became available which could be discharged against a high fore-vacuum pressure as a result of provision on their fore-vacuum side of additional pumping stages, for example, molecular pump stages which can be formed, for example, by a Holwerk pump. When such a pump is separated from a fore-vacuum pump for some time, it can provide a pressure ratio and a suction speed which do not affect the process that takes place at the high-vacuum side. This provided a possibility to use a dischargeable into the atmosphere fore-vacuum pump, which generates fore-vacuum for the turbomolecular pump, for the evacuation of another vacuum chamber when it becomes disconnected from the high-vacuum pump.

The provision, according to the present invention, of two valves, which connect the vacuum pump with the high-vacuum pump and the second vacuum chamber and which are alternatively opened and closed for evacuating one or the other of the vacuum chambers which at all times are separated from each other, permitted to eliminate the need in the second vacuum pump. This substantially reduced manufacturing and operational costs and reduced the space requirement for the vacuum system.

For obtaining a high vacuum, pumps having a high vacuum stability can be used as high-vacuum pumps. This is because with such pumps, a temporary separation of the fore-vacuum pump does not affect the high-vacuum side of such high-vacuum pumps. Turbomolecular pumps with additional molecular pumping stages at the fore-vacuum side proved to be particularly suitable for use as a high-vacuum pumps.

The invention is particularly effective when the second vacuum chamber is used as a gate chamber for loading and unloading of the first vacuum chamber.

The novel features of the present invention, which are considered as characteristic for the invention, which are considered as characteristic for the invention, are set forth in the appended claims. The invention itself, however, both as to its construction and its mode of operation, together with additional advantages and objects thereof, will be best understood from the following detailed description of preferred embodiments, when read with reference to the accompanying drawings.

BRIEF DESCRIPTION OF THE DRAWINGS

Single FIGURE shows a schematic view of a vacuum system according to the present invention.

DETAILED DESCRIPTION OF THE PREFERRED EMBODIMENT

A vacuum system, which is shown in the drawing, includes a first vacuum chamber connected with a high-vacuum pump 3. Fore-vacuum for the high-vacuum pump 3 is produced by a vacuum pump 4 which is connected with the high-vacuum pump 3 by a first valve 5 and is discharged into atmosphere. Another valve 6 connects the vacuum pump 4 with a second vacuum chamber 2 which can be connected, in case it is used as a gate chamber, with the first vacuum chamber by a valve 7.

The vacuum pump 4 can be used for producing fore-vacuum for the high-vacuum pump 3 and for producing vacuum in the second vacuum chamber 2. The evacuation process can be effected as follows:

With the first valve 5 being open, the first vacuum chamber 1 is evacuated via the high-vacuum pump 3 and the vacuum pump 4, with the second vacuum chamber 2 being separated by the second valve 6 from the vacuum pump 4 and the high-vacuum pump 3. After the first valve 5 is closed and, subsequently, the second valve 6 is opened, the second vacuum chamber 2 is evacuated by the vacuum pump 4. Then, the second valve 6 is closed again and, finally, the first valve 5 is opened again to provide for further evacuation of the first vacuum chamber 1 via the high-vacuum pump 3.

It is within the scope of the present invention to first evacuate the second vacuum chamber 2, with the second valve 6 being open and the first valve 5 being closed. It is also possible to evacuate both vacuum chambers 1 and 2 simultaneously at the start of the evacuation process.

Though the present invention was shown and described with references to the preferred embodiments, such are merely illustrative of the present invention and are not to be construed as a limitation thereof and various modifications of the present invention will be apparent to those skilled in the art. It is therefore not intended that the present invention be limited to the disclosed embodiments or details thereof, and the present invention includes all variations and/or alternative embodiments within the spirit and scope of the present invention as defined by the appended claims.

What is claimed is:

1. A method of operating a multi-chamber vacuum system including a first processing vacuum chamber connected with a high-vacuum pump, and a second processing vacuum chamber, the method compromising the steps of:

providing a dischargeable into atmosphere, vacuum pump for producing vacuum in both first and second processing vacuum chambers;

providing a first valve for connecting the vacuum pump with the first processing vacuum chamber, via the high-vacuum pump;

providing a second valve for connecting the vacuum pump with the second processing vacuum chamber; and at full operation of the high-vacuum pump, closing the first valve and opening the second valve for evacuating the second processing vacuum chamber.

2. A method as set forth in claim 1, further comprising the step of closing, after evacuation of the second processing vacuum chamber, the second valve and opening the first valve for further evacuation, via the high-vacuum pump, of the first processing vacuum chamber.

* * * * *